US010441970B2

(12) United States Patent
Sato et al.

(10) Patent No.: US 10,441,970 B2
(45) Date of Patent: Oct. 15, 2019

(54) METHOD FOR FORMING MULTILAYER COATED FILM

(71) Applicants: KANSAI PAINT CO., LTD., Amagasaki-shi (JP); TOYOTA JIDOSHA KABUSHIKI KAISHA, Aichi-ken (JP)

(72) Inventors: Kazuhide Sato, Aichi-ken (JP); Hiroshi Murata, Aichi-ken (JP); Yoshiaki Ukai, Aichi-ken (JP); Keiji Ambo, Aichi-ken (JP); Katsunori Ito, Aichi-ken (JP); Akiyo Tsukamoto, Aichi-ken (JP)

(73) Assignees: KANSAI PAINT CO., LTD., Hyogo, Amagasaki-shi (JP); TOYOTA JIDOSHA KABUSHIKI KAISHA, Aichi-ken (JP)

( * ) Notice: Subject to any disclaimer, the term of this patent is extended or adjusted under 35 U.S.C. 154(b) by 69 days.

(21) Appl. No.: 15/084,809

(22) Filed: Mar. 30, 2016

(65) Prior Publication Data

US 2016/0288164 A1 Oct. 6, 2016

(30) Foreign Application Priority Data

Mar. 31, 2015 (JP) ..... 2015-073523

(51) Int. Cl.
*B05D 5/06* (2006.01)
*B05D 7/00* (2006.01)

(52) U.S. Cl.
CPC ..... *B05D 5/068* (2013.01); *B05D 7/576* (2013.01)

(58) Field of Classification Search
CPC ..... B05D 7/576
See application file for complete search history.

(56) References Cited

U.S. PATENT DOCUMENTS

| | | | | |
|---|---|---|---|---|
| 4,978,394 | A * | 12/1990 | Ostertag | A61Q 1/02 106/404 |
| 6,165,621 | A | 12/2000 | Kasari et al. | |
| 2002/0069822 | A1 * | 6/2002 | Dattilo | B05B 12/1418 118/612 |
| 2004/0028823 | A1 * | 2/2004 | Dutt | B05D 7/574 427/385.5 |
| 2005/0031873 | A1 * | 2/2005 | Berschel | B05D 7/572 428/411.1 |
| 2005/0214483 | A1 | 9/2005 | Fujieda et al. | |
| 2009/0246545 | A1 * | 10/2009 | Nomi | B05D 7/572 428/480 |
| 2015/0202655 | A1 | 7/2015 | Nakano et al. | |
| 2015/0217332 | A1 | 8/2015 | Fuji et al. | |

FOREIGN PATENT DOCUMENTS

| | | | |
|---|---|---|---|
| JP | 2001-314807 | A | 11/2001 |
| JP | 2005255948 | A | 9/2005 |
| JP | 2005305424 | A | 11/2005 |
| JP | 2007-167720 | A | 7/2007 |
| JP | 2012-232236 | A | 11/2012 |
| JP | 2013052348 | A | 3/2013 |
| JP | 2014-42891 | A | 3/2014 |
| JP | 2014-42892 | A | 3/2014 |
| WO | 97/47396 | A1 | 12/1997 |

* cited by examiner

*Primary Examiner* — Francisco W Tschen
(74) *Attorney, Agent, or Firm* — Sughrue Mion, PLLC

(57) ABSTRACT

A method for forming a multilayer coated film on an object includes steps (1) to (3) below. A first colored coating material is applied to the object, thereby forming a first colored coated film (step (1)). The first colored coating material includes an iron-oxide-coated aluminum pigment and a quinacridone pigment and has a light reflectance property at specific wavelengths. A second colored coating material is applied to the first colored coated film, thereby forming a second colored coated film (step (2)). The second colored coating material includes a perylene pigment and has a specific hue. A clear coating material is applied to the second colored coated film (step (3)). A color difference ΔE between the first colored coated film and the multilayer coated film is in a range of 20 to 30.

4 Claims, No Drawings

METHOD FOR FORMING MULTILAYER COATED FILM

CROSS-REFERENCE TO RELATED APPLICATIONS

This application claims priority from Japanese Patent Application No. 2015-073523 filed on Mar. 31, 2015, the entire subject matter of which is incorporated herein by reference.

BACKGROUND OF THE INVENTION

Technical Field

An aspect of the present invention relates to a method for forming a multilayer coated film. More particularly, an aspect of the present invention relates to a method for forming a reddish multilayer coated film on an object to be coated which has undergone electrodeposition coating and intermediate coating.

Background Art

Mainly used as exterior colors of industrial products such as motor vehicles are metallic paint colors which change in color appearance depending on viewing angles. Furthermore, a paint color which has high chroma when viewed over the range of the highlight (direction of regular reflection) position to the shade (directions of diffuse reflection) positions and gives a sense of excellent deepness is one of paint colors for which there is a great request from users as paint colors that give a feeling of high grade and have excellent visual attraction.

As methods for obtaining such a metallic paint color, various methods for forming a metallic coated film in which a metallic base coating material, a second base coating material having transparency, and a clear coating material are successively applied have been disclosed (see, for example, Patent Documents 1, 2, 3, and 4).

Patent Document 1: WO: 97/47396

Patent Document 2: JP-A-2001-314807

Patent Document 3: JP-A-2007-167720

Patent Document 4: JP-A-2014-42891

SUMMARY OF THE INVENTION

The method of Patent Document 1 has problems in that the paint color changes considerably with even slight variations in the thickness of the coated film formed from the second base coating material having transparency and, hence, difficulties are encountered in the control of the coating line and that the so-called architrave phenomenon in which the edge parts which are prone to have a larger thickness than general parts have a deeper color is apt to occur. In addition, the method of Patent Document 1 has a problem in that the coated film has insufficient weatherability.

The method of Patent Document 2 has problems in that the coated film has insufficient chroma and there are cases, for example, where variations in film thickness result in unevenness in paint color and that the coated film has insufficient weatherability.

The method of Patent Document 3 is effective in inhibiting the occurrence of color unevenness in the same paint surface due to variations in film thickness. However, there is a drawback in that the face (intermediate between the highlight and the shade) of the multilayer film has insufficient chroma.

The method of Patent Document 4 is effective in inhibiting the occurrence of color unevenness in the same paint surface due to variations in film thickness. However, there are cases where the inhibition of color variations between portions due to variations in film thickness is insufficient.

As described above, in metallic paint colors having high chroma, in particular, in reddish high-chroma metallic paint colors, it has been difficult to achieve both of the weatherability of the coated films and applicability for attaining an even satisfactory finish appearance throughout the whole coated surface even when the film thickness varies.

An aspect of the present invention provides a method for multilayer coated film formation that inhibits color variations due to film thickness variations, making it possible to obtain an even and satisfactory finish appearance over the whole coated surface and that is capable of forming a multilayer coated film which has a reddish high-chroma color, gives a sense of excellent deepness, and further has excellent weatherability.

The present inventors diligently made investigations in order to overcome the problems. As a result, the inventors have found that the problems can be solved by forming a coated film using a specific first colored coating material and a specific second colored coating material. The present invention has been thus completed.

That is, an aspect of the present invention provides the following method for forming a multilayered coated film and coated article.

[1] A method for forming a multilayer coated film on an object to be coated, the object to be coated having undergone electrodeposition coating and intermediate coating, the method including the following steps (1) to (3):

step (1): applying a first colored coating material to the object, thereby forming a first colored coated film, the first colored coating material containing an iron-oxide-coated aluminum pigment and a quinacridone pigment and giving a cured coated film which, when having a thickness of 10 μm, has a light reflectance in a range of 30% to 35% at wavelengths of 650 nm to 700 nm and has a light reflectance in a range of 15% or less at wavelengths of 410 nm to 440 nm and at wavelengths of 510 nm to 590 nm, step (2): applying a second colored coating material to the first colored coated film, thereby forming a second colored coated film, the second colored coating material containing a perylene pigment and giving a cured coated film which, when having a thickness of 7 μm, has a hue in a range of 35°±5° in terms of hue angle h according to L*C*h color system chromaticity diagram, and step (3): applying a clear coating material to the second colored coated film, thereby forming a clear coated film, wherein a color difference ΔE between the first colored coated film and the multilayer coated film obtained by the steps (1) to (3) is in a range of 20 to 30.

[2] The method for forming a multilayer coated film according to [1], wherein the first colored coated film has a thickness in a range of 5 μm to 15 μm in terms of the thickness of the cured coated film.

[3] The method for forming a multilayer coated film according to [1] or [2], wherein the second colored coated film has a thickness in a range of 4 μm to 10 μm in terms of the thickness of the cured coated film.

[4] A coated article obtained by the method for forming a multilayer coated film according to any one of [1] to [3].

According to the method for multilayer coated film formation in an aspect of the present invention, since color variations due to variations in film thickness can be inhibited, a reddish high-chroma finish appearance which gives a sense of excellent deepness can be evenly imparted to the whole coated surface. In addition, the multilayer coated film thus formed has so high weatherability that even when a coated article is allowed to stand outdoors over a long period, deteriorations such as discoloration and fading are little recognized.

DETAILED DESCRIPTION OF THE INVENTION

The method for forming a multilayer coated film in aspect of the present invention (hereinafter often referred to simply as "method in an aspect of the present invention") is a method for forming a multilayer coated film on an object to be coated which has undergone electrodeposition coating and intermediate coating, the method including the following steps (1) to (3):

step (1): applying a first colored coating material to the object, thereby forming a first colored coated film, the first colored coating material containing an iron-oxide-coated aluminum pigment and a quinacridone pigment and giving a cured coated film which, when having a thickness of 10 μm, has a light reflectance in a range of 30% to 35% at wavelengths of 650 nm to 700 nm and has a light reflectance in a range of 15% or less at wavelengths of 410 nm to 440 nm and at wavelengths of 510 nm to 590 nm, step (2): applying a second colored coating material to the first colored coated film, thereby forming a second colored coated film, the second colored coating material containing a perylene pigment and giving a cured coated film which, when having a thickness of 7 μm has a hue in a range of 35°±5° in terms of hue angle h according to L*C*h color system chromaticity diagram, and step (3): applying a clear coating material to the second colored coated film, thereby forming a clear coated film.

<Step (1)>

According to the method in an aspect of the present invention, as the step (1), firstly a first colored coating material is applied to an object to be coated which has undergone electrodeposition coating and intermediate coating, thereby forming a first colored coated film. The first colored coating material is a coating material which imparts base-hiding properties to the multilayer coated film to be obtained by the method in an aspect of the present invention and which determines the hue of the multilayer coated film to be formed, in particular, the hue of the shade part.

An iron-oxide-coated aluminum pigment as a glitter pigment and a quinacridone pigment as an organic red pigment are contained as essential components in the first colored coating material.

In the first colored coating material, the iron-oxide-coated aluminum pigment as a glitter pigment is used from the standpoint of effectively improving the base-hiding properties and the weatherability of the multilayer coated film to be obtained.

As the iron-oxide-coated aluminum pigment to be suitably used, examples thereof include a pigment which makes a coated film containing the iron-oxide-coated aluminum pigment as the only colorant, the coated film having a hue in the range of 0° to 50°, in particular, in the range of 20° to 40°, in terms of hue angle h in L*C*h color system chromaticity diagram. By using an iron-oxide-coated aluminum pigment which brings about a hue angle h within that range, a multilayer coated film having high chroma even when viewed from any viewing angle can be obtained.

The "L*C*h color system" is one obtained by converting the L*a*b* color system prescribed by the International Commission on Illumination in 1976 and employed in JIS Z 8729 into polar coordinates; L* indicates lightness, C* indicates chroma in terms of distance from the origin, and h indicates hue angle formed by rotation from the axis of redness a* in the L*a*b* color system, as 0°, to the hue anticlockwise.

The hue angle h can be measured using MA-68 (trade name), manufactured by X-Rite Inc., which is a multiangle spectrophotometer, CR series (trade name), manufactured by Konica Minolta Inc., which is a color and color-difference meter, SN Color Computer (trade name), manufactured by Suga Test Instruments Co., Ltd., etc.

The iron-oxide-coated aluminum pigment is not particularly limited. Examples thereof include colored aluminum flake pigments having excellent weatherability and constituted of an aluminum substrate coated with iron oxide by chemical vapor deposition, such as those described in, for example, JP-A-H06-145555 with respect to a production process therefore and features thereof.

One iron-oxide-coated aluminum pigment can be used alone, or two or more kinds of iron-oxide-coated aluminum pigments can be used in combination.

The amount of the iron-oxide-coated aluminum pigment to be incorporated is generally regulated so as to be in the range of preferably 1% to 20% by mass, more preferably 1% to 15% by mass, even more preferably 2% to 10% by mass, based on the total amount of resin solid components in the first colored coating material. In a case where the amount of the iron-oxide-coated aluminum pigment incorporated into the first colored coating material is within that range, it is possible to obtain a multilayer coated film which is excellent in terms of all of graininess, flip-flop property, and chroma. In a case where the amount of the iron-oxide-coated aluminum pigment is less than the lower limit, there is a possibility that the multilayer coated film might be insufficient in flip-flop property or chroma. In a case where the amount thereof exceeds the upper limit, there is a possibility that the multilayer coated film might have too high graininess and have a rough finish appearance.

As glitter pigments (in particular, metal flake pigments), examples thereof include the iron-oxide-coated aluminum pigment, conventional glitter pigments for coating materials and the like. These glitter pigments may be used alone or in combination of two or more kinds thereof.

Specific examples thereof include: flaky metallic pigments made of materials such as aluminum, copper, a nickel alloy, or stainless steel, flaky metallic pigments in which the surfaces have been coated with a metal oxide (excluding iron-oxide-coated aluminum pigments), and flaky metallic pigments in which a color pigment has been chemically adsorbed onto the surfaces; flaky aluminum pigments in which an aluminum oxide layer has been formed on the surfaces by an oxidation-reduction reaction; platy iron oxide pigments containing solid-solution aluminum; glass flake pigments, glass flake pigments in which the surfaces have been coated with a metal oxide, and glass flake pigments in which a color pigment has been chemically adsorbed onto the surfaces; interference mica pigments in which the surfaces have been coated with titanium dioxide, reduced mica pigments obtained by reducing the interference mica pigments, and colored mica pigments in which a color pigment has been chemically adsorbed onto the surfaces or the surfaces have been coated with iron oxide; graphite pigments in which the surfaces have been coated with titanium dioxide; silica flake or alumina flake pigments in which the surfaces have been coated with titanium dioxide or iron oxide; platy iron oxide pigments; hologram pigments; synthetic mica pigments; cholesteric liquid-crystal polymer pigments having a helical structure; bismuth oxychloride pigments and the like.

Preferable examples thereof include flaky metallic pigments, flaky metallic pigments in which the surfaces have been coated with a metal oxide (excluding iron-oxide-coated aluminum pigments), flaky metallic pigments in which a color pigment has been chemically adsorbed onto the surfaces, and colored mica pigments in which the surfaces have been coated with a metal oxide. Especially suitable examples thereof include aluminum flake pigments, which are flaky metallic pigments. However, the glitter pigment should not be construed as being limited to those examples, and one or more glitter pigments can be suitably used in accordance with the hiding properties and chroma of the coated film and the desired glitter.

The content of the glitter pigment including the iron-oxide-coated aluminum pigment is generally regulated so as to be in the range of preferably 1% to 30% by mass, more preferably 2% to 20% by mass, even more preferably 3% to 15% by mass, based on the total amount of resin solid components in the first colored coating material.

In the first colored coating material, the quinacridone pigment as an organic red pigment is used from the standpoint of effectively improving the chroma and weatherability of the multilayer coated film to be obtained.

Examples of the quinacridone pigment include C.I. Pigment Violet 19, C.I. Pigment Red 122, C.I. Pigment Red 209, C.I. Pigment Red 202, C.I. Pigment Orange 48, and C.I. Pigment Orange 49. The quinacridone should not be construed as being limited to those examples.

Such quinacridone pigments can be used either alone or in combination of two or more kinds thereof.

The amount of the quinacridone pigment to be incorporated is generally regulated so as to be in the range of preferably 1% to 20% by mass, more preferably 2% to 15% by mass, even more preferably 3% to 10% by mass, based on the total amount of resin solid components in the first colored coating material. In a case where the amount of the quinacridone pigment incorporated into the first colored coating material is within that range, it is possible to obtain a multilayer coated film which is excellent in terms of all of coloring power, chroma, smoothness, and weatherability. In a case where the amount of the quinacridone pigment is less than the lower limit, there is a possibility that the multilayer coated film might be insufficient in coloring power or chroma. In a case where the amount thereof exceeds the upper limit, there is a possibility that the multilayer coated film might be poor in smoothness or weatherability.

As organic red pigments, examples thereof include the quinacridone pigment, conventional pigments for coating materials or inks. These pigments may be used alone or in combination of two or more kinds thereof in accordance with the desired tint.

Specific examples of such organic red pigments include azo pigments, diketopyrrolopyrrole pigments, perylene pigments, and perinone pigments.

The content of the organic red pigment(s) including the quinacridone pigment is preferably in the range of 1% to 25% by mass, more preferably in the range of 2% to 20% by mass, based on the total amount of resin solid components in the first colored coating material, from the standpoint of the chroma of the multilayer coated film to be obtained.

The first colored coating material can contain one or more color pigments other than the organic red pigments according to need. As color pigments other than the organic red pigments, conventional pigments for inks or coating materials can be used alone or in combination of two or more kinds thereof.

Specific examples thereof include: metal oxide pigments such as titanium oxide and iron oxide; composite metal oxide pigments such as titanium yellow; carbon black; and organic pigments such as benzimidazolone pigments, isoindoline pigments, isoindolinone pigments, metal chelate azo pigments, phthalocyanine pigments, indanthrone pigments, dioxane pigments, and indigo pigments.

The amount of the color pigment(s) to be incorporated besides the organic red pigment(s) is not particularly limited. However, the amount thereof is generally regulated so as to be in the range of preferably 10% by mass or less, more preferably 5% by mass or less, even more preferably 3% by mass or less, especially preferably 2% by mass or less, based on the total amount of resin solid components in the first colored coating material, from the standpoint of obtaining a multilayer coated film having a reddish high-chroma color.

Of those pigments, iron oxide is especially suitable from the standpoint of improving the weatherability of the multilayer coated film. The content of the iron oxide may be regulated so as to be in the range of preferably 5% by mass or less, more preferably 3% by mass or less, especially preferably 0.1% to 2.0% by mass, based on the total amount of resin solid components in the first colored coating material, from the standpoint of achieving both of weatherability and chroma.

In the method in an aspect of the present invention, color pigments which have undergone an inorganic and/or organic surface treatment for improving dispersibility, weatherability, etc. can be used as the color pigments to be incorporated into the first colored coating material and into the second colored coating material and clear coating material which will be described later.

The total content of the pigments in the first colored coating material is preferably in the range of 1% to 50% by mass, more preferably in the range of 3% to 40% by mass, even more preferably in the range of 5% to 30% by mass, based on the total amount of resin solid components in the first colored coating material, from the standpoints of base-hiding property and the chroma and weatherability of the multilayer coated film to be obtained.

The first colored coating material can usually contain a resin component as a vehicle. It is preferred to use a thermosetting resin composition as the resin component. Examples thereof include a thermosetting resin composition including: a base resin such as an acrylic resin, polyester resin, alkyd resin, or urethane resin, which has crosslinkable functional groups such as hydroxyl groups; and a crosslinking agent such as a melamine resin, urea resin, or polyisocyanate compound (including a blocked one). These ingredients can be used in the state of having been dissolved or dispersed in a solvent such as an organic solvent and/or water. The proportion of the base resin to the crosslinking agent in the resin composition is not particularly limited. In general, however, the crosslinking agent can be used in an amount in the range of 10% to 100% by mass, preferably 20% to 80% by mass, more preferably 30% to 60% by mass, based on the total solid amount of the base resin.

A solvent such as water or an organic solvent, various additives for coating materials, such as a rheology control agent, pigment dispersant, anti-settling agent, curing catalyst, antifoaming agent, antioxidant, and ultraviolet absorber, an extender pigment, etc. can be suitably further incorporated into the first colored coating material according to need.

From the standpoint of reducing the amount of VOCs, it is preferable that the first colored coating material should be a water-based coating material.

The "water-based coating material" is a term used in comparison with organic-solvent-based coating materials. That term generally means a coating material in which a resin for coated film formation, a pigment, etc. are dispersed and/or dissolved in water or a medium (aqueous medium) including water as the main component. In the case where the first colored coating material is a water-based coating material, the content of water in this first colored coating material is preferably about 20% to 80% by mass, more preferably about 30% to 70% by mass.

The first colored coating material can be prepared by mixing and dispersing the ingredients described above. It is preferable that the solid content of the coating material during application should have been regulated to 12% to 60% by mass. The content thereof is more preferably 15% to 50% by mass. In a case where the solid content of the first colored coating material during application is within that range, the coated surface can be evenly finished efficiently.

Although the pigments to be incorporated into the first colored coating material or into the second colored coating material or clear coating material which will be described later can be incorporated in a powder form into the coating material, it is also possible to use a method in which the pigments are mixed with and dispersed in some of the resin components of the coating material to prepare a pigment dispersion and this pigment dispersion is mixed with the remainder of the resin components or with other ingredients to thereby produce the coating material. When preparing the pigment dispersion, common additives for coating materials, such as an antifoaming agent, dispersant, and surface regulator, can be used according to need.

In an aspect of the present invention, the first colored coating material is prepared while regulating the proportions of the pigments so that in a case where the coating material is applied so as to result in a cured-coated film thickness of 10 μm, the coated film obtained has an average light reflectance of 30% to 35% at wavelengths of 650 nm to 700 nm and has an average light reflectance of 15% or less at wavelengths of 410 nm to 440 nm and at wavelengths of 510 nm to 590 nm. By regulating the proportions of the pigments so that the cured coated film satisfies the ranges of average light reflectance for the respective wavelength ranges, a (multilayer) coated film having a high-chroma reddish color is obtained.

The average light reflectance of the cured film having a thickness of 10 μm at wavelengths of 650 nm to 700 nm is preferably in the range of 30% to 34%. The average light reflectance thereof at wavelengths of 410 nm to 440 nm and that at wavelengths of 510 nm to 590 nm are each preferably 10% or less.

The light reflectance herein is defined as a value determined by applying the coating material to a smooth PTFE (polytetrafluoroethylene) plate so as to result in a cured-film thickness of 10 μm, curing the coating material applied, stripping off the cured coated film, and examining the film with a spectrophotometer UV3700 (trade name; manufactured by Shimadzu Corp.).

The first colored coating material can be applied by a technique such as electrostatic coating, air spraying, air-less spraying, etc., so as to result in a thickness in the range of 1 μm to 25 μm in terms of cured-coated film thickness. An especially suitable range of the thickness thereof is 5 μm to 15 μm from the standpoints of the smoothness of the coated film, etc.

It is preferable that the first colored coating material should be prepared so that the solid concentration therein is usually 10% to 50% by mass, preferably 15% to 40% by mass, and that the 6-rpm viscosity thereof measured at 20° C. with a Brookfield rotational viscometer is usually 1,000 mPa·s to 8,000 mPa·s, in particular, 2,000 mPa·s to 7,000 mPa·s.

The first colored coated film itself obtained by applying the first colored coating material can be cured usually at a temperature of about 50° C. to 180° C. in the case where the coating material is a baking drying type material, although the temperature varies depending on the thermosetting resin composition. In the case of the ordinary temperature drying type material or the forced drying type material, the coated film can be cured usually at a temperature of ordinary temperature to about 80° C.

In the method in an aspect of the present invention, a second colored coating material can be applied after the first colored coated film obtained by applying the first colored coating material is cured. Alternatively, it is possible to apply a second colored coating material on the first colored coated film in the uncured state, without curing the first colored coated film.

<Step (2)>

According to the method in an aspect of the present invention, a second colored coating material is then applied to the first colored coated film formed in step (1), and a second colored coated film is formed thereby. The second colored coating material is a coating material for enhancing the chroma of the multilayer coated film to be formed and improving the deepness thereof. This coating material contains a perylene pigment, which is an organic red pigment, as an essential component.

In the second colored coating material, the perylene pigment as an organic red pigment is used from the standpoint of effectively improving the weatherability of the multilayer coated film to be obtained.

Examples of the perylene pigment include C.I. Pigment Violet 29, C.1. Pigment Red 190, C.I. Pigment Red 224 and the like. However, the perylene pigment should not be construed as being limited to these examples.

Such perylene pigments can be used either alone or in combination of two or more kinds thereof.

The amount of the perylene pigment to be incorporated is generally regulated so as to be in the range of preferably 0.01% to 15% by mass, more preferably 0.05% to 10% by mass, even more preferably 0.1% to 5% by mass, based on the total amount of resin solid components in the second colored coating material. In a case where the amount of the perylene pigment incorporated into the second colored coating material is within that range, it is possible to obtain a multilayer coated film which is excellent in terms of all of coloring power, chroma, smoothness, and weatherability. In a case where the amount of the perylene pigment is less than the lower limit, there is a possibility that the multilayer coated film might be insufficient in coloring power or chroma. In a case where the amount thereof exceeds the upper limit, there is a possibility that the multilayer coated film might have reduced lightness and might be poor in smoothness or weatherability.

As organic red pigments to be used in the second colored coating material, examples thereof include perylene pigment, and conventional pigments for coating materials or inks. These pigments may be used alone or in combination of two or more kinds thereof in accordance with the desired tint.

Specific examples of the organic red pigments other than perylene pigments include azo pigments, quinacridone pigments, diketopyrrolopyrrole pigments, perinone pigments and the like.

With respect to the organic red pigment(s) in the second colored coating material, it is preferred to minimize the amount of a quinacridone pigment to be used, from the standpoint of improving the weatherability of the multilayer coated film to be obtained. It is most preferred to use substantially no quinacridone pigment (it is not preferred to use no quinacridone pigment).

The content of the organic red pigment(s) including the perylene pigment in the second colored coating material is in the range of preferably 0.01% to 15% by mass, more preferably 0.05% to 10% by mass, even more preferably 0.1% to 5% by mass, based on the total amount of resin solid components in the second colored coating material, from the standpoint of the chroma and weatherability of the multilayer coated film to be obtained.

The second colored coating material can contain one or more color pigments other than the organic red pigments according to need. As the color pigments other than the organic red pigments, conventional pigments for inks or coating materials can be used alone or in combination of two or more kinds thereof.

Specific examples thereof include: metal oxide pigments such as titanium oxide and iron oxide; composite metal oxide pigments such as titanium yellow; carbon black; and organic pigments such as benzimidazolone pigments, isoindoline pigments, isoindolinone pigments, metal chelate azo pigments, phthalocyanine pigments, indanthrone pigments, dioxane pigments, indigo pigments, and the like.

The amount of the color pigment(s) to be incorporated besides the organic red pigment(s) is not particularly limited. However, the amount thereof can be generally regulated so as to be in the range of 10% by mass or less, preferably 5% by mass or less, especially preferably 3% by mass or less, based on the total amount of resin solid components in the second colored coating material, from the standpoint of obtaining a multilayer coated film having a reddish high-chroma color.

It is preferable that iron oxide, among those pigments, should be contained from the standpoint of improving the weatherability of the multilayer coated film. The content of the iron oxide can be regulated so as to be in the range of 7.5% by mass or less, preferably 5% by mass or less, more preferably 2.5% by mass or less, especially preferably 0.1% to 1% by mass, based on the total amount of resin solid components in the second colored coating material, from the standpoint of achieving both of the weatherability and chroma of the multilayer coated film.

Any of the glitter pigments shown above as examples with regard to the first colored coating material can be used in the second colored coating material according to need.

The total content of the pigment(s) in the second colored coating material is preferably in the range of 0.05% to 15% by mass, especially preferably in the range of 0.1% to 10% by mass, based on the total amount of resin solid components in the second colored coating material, from the standpoint of the chroma and deepness of the multilayer coated film to be obtained.

The second colored coating material can usually contain a resin component as a vehicle. It is preferred to use a thermosetting resin composition as the resin component. Examples thereof include a thermosetting resin composition including: a base resin such as, for example, an acrylic resin, polyester resin, alkyd resin, or urethane resin, which has crosslinkable functional groups such as hydroxyl groups; and a crosslinking agent such as a melamine resin, urea resin, or polyisocyanate compound (including a blocked one). These ingredients can be used in the state of having been dissolved or dispersed in a solvent such as an organic solvent and/or water. The proportion of the base resin to the crosslinking agent in the resin composition is not particularly limited. In general, however, the crosslinking agent can be used in an amount in the range of 10% to 100% by mass, preferably 20% to 80% by mass, more preferably 30% to 60% by mass, based on the total solid amount of the base resin.

A solvent such as water or an organic solvent, various additives for coating materials, such as a rheology control agent, pigment dispersant, anti-settling agent, curing catalyst, antifoaming agent, antioxidant, and ultraviolet absorber, an extender pigment, etc. can be suitably further incorporated into the second colored coating material according to need.

It is preferable that, like the first colored coating material, the second colored coating material should be a water-based coating material from the standpoint of reducing the amount of VOCs.

In the case where the second colored coating material is a water-based coating material, the content of water in this second colored coating material is preferably about 20% to 80% by mass, more preferably about 30% to 70% by mass.

The second colored coating material can be prepared by mixing and dispersing the ingredients described above.

In an aspect of the present invention, in the second colored coating material, in a case where the coating material is applied so as to result in a cured-coated film thickness of 7 μm, the coated film obtained has a hue in the range of 35°±5° in terms of hue angle h according to the L*C*h color system chromaticity diagram. In a case where the hue of that coated film is 35°±5° in terms of hue angle h, it is possible to obtain a multilayer coated film having high chroma and excellent weatherability. The hue angle h of the second colored coated film is more preferably in the range of 35±3°.

The hue angle h of the second colored coated film is a value obtained by applying the second colored coating material to a white plate having a lightness L* of 85 or higher as a base so as to result in a dry-coating-film thickness of 7 μm, drying the applied coating material by heating at 140° C. for 30 minutes, and measuring the color of the resultant coated plate with a multiangle spectrophotometer (MA-68 (trade name), manufactured by X-Rite Inc.) to determine the hue angle h according to the L*C*h color system. The light-receiving angle was set at 45°, which corresponded to the face.

The second colored coating material can be applied by a technique such as electrostatic coating, air spraying, air-less spraying, etc., so as to result in a thickness in the range of 0.5 μm to 20 μm in terms of cured-coated film thickness. An especially suitable range of the thickness thereof is 4 μm to 10 μm, in particular, 5 μm to 8 μm, from the standpoints of the smoothness of the coated film, etc.

It is preferable that the second colored coating material should be prepared so that the solid concentration therein is usually 15% to 50% by mass, preferably 20% to 40% by mass, and that the 6-rpm viscosity thereof measured at 20° C. with a Brookfield rotational viscometer is usually 1,000 mPa·s to 8,000 mPa·s, in particular, 2,000 mPa·s to 7,000 mPa·s.

It is preferable that the second colored coated film formed from the second colored coating material, when examined in the thickness of the coated film formed, should have a light transmittance in the range of 20% to 90%, preferably 25% to 60%, in terms of transmittance of light having a wavelength range of 400 nm to 700 nm The term "transmittance of light having a wavelength range of 400 nm to 700 nm" herein means an average of light transmittances for the respective wavelengths in the range of 400 nm to 700 nm The second colored coated film itself obtained by applying the second colored coating material can be cured usually at a temperature of about 50° C. to 180° C. in the case where the coating material is the baking drying type material, although the temperature varies depending on the thermosetting resin composition. In the case of the ordinary temperature drying type material or the forced drying type material, the coated film can be cured usually at a temperature of ordinary temperature to about 80° C.

In the method in an aspect of the present invention, a clear coating material can be applied after the second colored coated film obtained by applying the second colored coating material is cured. Alternatively, it is possible to apply a clear coating material on the second colored coated film in the uncured state, without curing the second colored coated film.

<Step (3)>

According to the method in an aspect of the present invention, a clear coating material is applied to the second colored coated film obtained by applying the second colored coating material in the manner described above, thereby forming a clear coated film.

As the clear coating material for use in the method in an aspect of the present invention, any of clear coating materials which themselves are conventional can be used without particular limitations. Examples thereof include a liquid or powder-form clear coating material which includes, for example, a base resin and a crosslinking agent as essential resin components and optionally further contains additives for coating materials, a solvent such as water or an organic solvent, etc. and which forms a colorless or colored, transparent coated film.

Examples of the base resin include resins, such as acrylic resins, polyester resins, alkyd resins, fluororesins, urethane resins, or silicone-containing resins, that have crosslinkable functional groups such as hydroxyl group, carboxyl group, silanol group, or epoxy group. Examples of the crosslinking agent include compounds or resins which each have functional groups capable of reacting with the functional groups of the base resin. Specific examples of the crosslinking agent include melamine resins, urea resins, polyisocyanate compounds, blocked polyisocyanate compounds, epoxy compounds or resins thereof, carboxyl group-containing compounds or resins thereof, acid anhydrides, alkoxysilyl group-containing compounds or resins thereof, and the like.

The proportion of the base resin to the crosslinking agent in the resin components is not particularly limited. In general, however, the crosslinking agent can be used in an amount in the range of 10% to 100% by mass, preferably 20% to 80% by mass, more preferably 30% to 60% by mass, based on the total solid amount of the base resin.

A solvent such as water or an organic solvent, and additives for coating materials such as a curing catalyst, antifoaming agent, ultraviolet absorber, rheology control agent, and anti-settling agent can be suitably incorporated into the clear coating material according to need.

Furthermore, one or more color pigments can be suitably used in the clear coating material so long as the transparency of the coated film is not impaired thereby. Pigments which themselves are known as pigments for inks or coating materials can be used as the color pigments(s) either alone or in combination of two or more kinds thereof. The amount of the color pigment(s) to be incorporated varies depending on the kind(s) thereof, etc., but can be in the range of usually 30% by mass or less, preferably 0.05% to 20% by mass, more preferably 0.1% to 10% by mass, based on the total solid amount of resin components in the clear coating material.

The clear coating material can be prepared by mixing and dispersing the ingredients described above.

The clear coating material can be applied by a technique such as electrostatic coating, air spraying, air-less spraying, etc., and the thickness thereof in terms of cured-coated film thickness is preferably in the range of 15 μto 50 μm, in particular, 25 μm to 40 μm.

In a case where the clear coating material is liquid, it is preferable that this clear coating material should be prepared so that the solid concentration therein is 30% to 60% by mass, preferably 40% to 50% by mass, and the viscosity thereof, as measured at 20° C. using Ford cup No. 4, is 18 seconds to 30 seconds. The clear coated film itself obtained by applying the clear coating material can be cured usually by heating at a temperature of about 70° C. to 150° C., although the temperature varies depending on the resin components (the base resin and the crosslinking agent).

<Object to be Coated>

There are no particular limitations on the object to be coated, to which the method in an aspect of the present invention is applied. Examples thereof include: members made of metals such as iron, zinc, aluminum, and magnesium; members made of alloys of these metals; and members which have been coated with these metals by plating or vapor deposition. Steel materials which constitute the body of a motor vehicle are especially suitable. These members can be subjected to treatments such as degreasing or surface treatments according to need.

In an aspect of the present invention, the object to be coated may be an object which has undergone both electrodeposition coating for forming an undercoat film and intermediate coating for forming an intermediate coat film. Usually, electrodeposition coating and intermediate coating are conducted in this order.

The electrodeposition coating for forming an undercoat film is a coating operation given to the surface of a member in order to hide the surface of the member or to impart corrosion resistance, non-rusting properties, etc. to the member. The undercoat film can be formed by applying and curing an electrodeposition coating material. This electrodeposition coating material is not particularly limited, and use can be made of an electrodeposition coating material which itself is known. However, in a case where a high level of non-rusting properties are required as in bodies of motor vehicles, a cationic electrodeposition coating material can be suitably used. At present, electrodeposition coating with cationic electrodeposition coating materials is generally performed extensively as the undercoating of bodies of motor vehicles.

An intermediate coat film is applied to the base, such as the surface of a member or the undercoat film, in order to hide the base or to improve adhesion between the base and the coating films to be formed thereon, or for the purpose of for example, imparting chipping resistance to the coated films. The intermediate coat film can be formed by applying an intermediate coating material to the surface of the base, such as the surface of a member or the undercoat film, and curing the coating material applied. This intermediate coating material is not particularly limited, and use can be made of an intermediate coating material which itself is known.

For example, an organic-solvent-based or water-based intermediate coating material which includes a thermosetting resin composition, a color pigment, etc. can be suitably used.

In the method in an aspect of the present invention, the object to be coated which has undergone electrodeposition coating and intermediate coating can be heated or subjected to the other treatment to cure the coated films, and then, the cured coated films can be coated with the first colored coating material in step (1). In some cases, however, the first colored coating material can be applied to the object to be coated which has undergone intermediate coating and in which the intermediate coat film is in an uncured state.

<Formation of Multilayer Coated Film>

According to the method in an aspect of the present invention, the multilayer coated film is formed on the object to be coated which has undergone electrodeposition coating and intermediate coating, in accordance with the steps (1) to (3) explained above, i.e., step (1): applying a first colored coating material to the object, thereby forming a first colored coated film, the first colored coating material containing an iron-oxide-coated aluminum pigment and a quinacridone pigment and giving a cured coated film which, when having a thickness of 10 μm, has a light reflectance in a range of 30% to 35% at wavelengths of 650 nm to 700 nm and has a light reflectance in a range of 15% or less at wavelengths of 410 nm to 440 nm and at wavelengths of 510 nm to 590 nm, step (2): applying a second colored coating material to the first colored coated film, thereby forming a second colored coated film, the second colored coating material containing a perylene pigment and giving a cured coated film which, when having a thickness of 7 μm, has a hue in a range of 35°±5° in terms of hue angle h according to L*C*h color system chromaticity diagram, and step (3): applying a clear coating material to the second colored coated film, thereby forming a clear coated film, so that a color difference ΔE between the first colored coated film and the multilayer coated film is in the range of 20 to 30. Thus, a multilayer coated film in which color variations due to variations in thickness are reduced and which not only can hence have an even finish appearance with a reddish high-chroma color and excellent deepness over the whole coated surface but also has excellent weatherability can be formed.

In the method in an aspect of the present invention, the multilayer coated film obtained, the color difference in the L*a*b* color system (difference in the value of E, ΔE) between the first colored coated film obtained by applying the first colored coating material and the multilayer coated film is in the range of 20 to 30. By regulating the color difference ΔE to a value within that range, the hue angle of the multilayer coated film can be controlled.

The value of "ΔE" can be determined by measuring the color of the first colored coated film obtained by applying the first colored coating material to a steel plate and curing the coating material applied and the color of the multilayer coated film obtained by applying the first colored coating material, second colored coating material, and clear coating material in the steps (1) to (3) to a steel plate and curing the coating materials applied, by means of CR-400 (colorimeter; trade name; manufactured by Konica Minolta Inc.).

A value of color difference ΔE within that range can be attained by regulating the kinds and contents of the color pigments respectively contained in the first colored coating material and the second colored coating material.

The color difference ΔE between the first colored coated film and the multilayer coated film is preferably in the range of 20 to 27, more preferably in the range of 20 to 25, from the standpoint of obtaining a multilayer coated film having a higher chroma.

In an aspect of the present invention, since the first colored coated film (when examined in a thickness of 10 μn) has a light reflectance in the range of 30% to 35% at wavelengths of 650 nm to 700 nm and a light reflectance in the range of 15% or less at wavelengths of 410 nm to 440 nm and at wavelengths of 510 nm to 590 nm and the second colored coated film (when examined in a thickness of 7 μm) has a hue angle h in the range of 35°±5°, and since the first colored coated film, which has such specific light reflection characteristics and contains an iron-oxide-coated aluminum pigment and a quinacridone pigment, and the second colored coated film (having a transparent color), which has a hue within a specific range and contains a perylene pigment, are laminated, an effect which is advantageous (suitable) for obtaining a multilayer coated film having a reddish high-chroma color with excellent deepness and further having excellent weatherability can be brought about.

It is preferable that the multilayer coated film obtained by applying and curing the first colored coating material, second colored coating material, and clear coating material according to the steps (1) to (3) should have such a hue difference that the difference Δh between the hue angle h(1BC) of the first colored coated film obtained by applying the first colored coating material and the hue angle h(multilayer) of the multilayer coated film, i.e., h(multilayer)-h (1BC), is in the range of preferably +1 to 30, more preferably +2 to 25, even more preferably +4 to 20.

The color difference (ΔE) and hue angle difference (Δh) between the first colored coated film and the multilayer coated film formed by the steps (1) to (3) and the hue angles h of the first colored coated film and the second colored coated film can be easily regulated by regulating (through small-scale experiments) the kinds and use amounts of the pigments to be incorporated into the first colored coating material, second colored coating material, and clear coating material to be used for forming the multilayer coated film.

Similarly, the light reflectance of the first colored coated film can be easily regulated by regulating the kinds and use amounts of the pigments to be incorporated into the first colored coating material.

The thickness of the multilayer coated film to be obtained by the method in an aspect of the present invention is regulated to preferably 20 μm to 65 μm, more preferably 35 μm to 60 μm, in terms of the thickness of the cured coated film, from the standpoints of improving the appearance of the coated film and ensuring the performance thereof.

The method for forming a multilayer coated film in an aspect of the present invention is suitable for use in forming a multilayer coated film on various industrial products, in particular, on outside plates of bodies of motor vehicles. The coated article obtained by the method in an aspect of the present invention has a reddish high-chroma color with excellent deepness and further has excellent weatherability.

EXAMPLES

An aspect of the present invention is explained below in more detail by reference to Examples and Comparative Examples. However, the present invention should not be construed as being limited to the following Examples only. All "parts" and "%" are by mass, and the values of thickness are given in terms of cured-coated film thickness.

(1) Production of Object to be Coated

A steel sheet (HS G3141; size, 400 mm×300 mm×0.8 mm) which had been degreased and treated with zinc phosphate was subjected to electrodeposition coating with a cationic electrodeposition coating material "ELECRON GT-10" (trade name; manufactured by Kansai Paint Co., Ltd.; coating material using a cationic resin based on an epoxy resin/polyamine and a blocked polyisocyanate compound as a hardener) so as to result in the thickness of 20 μm in terms of cured-coated film thickness. The coating material applied was heated at 170° C. for 20 minutes to crosslink and cure it, thereby forming an electrodeposited coated film.

An intermediate coating material "LUGABAKE INTERMEDIATE COAT, GRAY" (trade name; manufactured by Kansai Paint Co., Ltd.; organic-solvent-based one including a polyester resin and a melamine resin) was applied to the electrodeposition-coated surface of the steel sheet by air spraying so as to result in the thickness of 30 μm in terms of cured-coated film thickness. The coating material applied was heated at 140° C. for 30 minutes to crosslink and cure it, thereby forming an intermediate coat film. The thus-obtained coated sheet which had undergone intermediate coating was used as an object to be coated.

(2) Production of Coating Materials

<Production of Base Resins>

Production Example 1

128 parts of deionized water and 2 parts of "ADEKA REASOAP SR-1025" (trade name; manufactured by ADEKA Corp.; emulsifying agent; effective component 25%) were introduced into a reaction vessel equipped with a thermometer, thermostat, stirrer, reflux condenser, nitrogen introduction tube, and dropping device. In a nitrogen stream, the contents were stirred and mixed and were heated to 80° C.

Subsequently, 1% of the whole of the following monomer emulsion for core formation and 5.3 parts of 6% aqueous ammonium persulfate solution were introduced into the reaction vessel, and the contents were held at 80° C. for 15 minutes. Thereafter, the remainder of the monomer emulsion for core formation was dropped over 3 hours into the reaction vessel kept at that temperature. After completion of the dropping, the contents were aged for 1 hour. Next, the following monomer emulsion for shell formation was dropped thereinto over 1 hour, and the contents were aged for 1 hour. Thereafter, the contents were cooled to 30° C. while gradually introducing 40 parts of 5% aqueous 2-(dimethylamino)ethanol solution into the reaction vessel. The resultant mixture was discharged while being filtered with a 100-mesh nylon cloth, thereby obtaining an acrylic resin emulsion (a) having an average particle diameter of 100 nm and a solid content of 30%. The acrylic resin emulsion obtained had an acid value of 33 mg-KOH/g and a hydroxyl value of 25 mg-KOH/g.

Monomer emulsion for core formation: A monomer emulsion for core formation was obtained by mixing and stirring 40 parts of deionized water, 2.8 parts of "ADEKA REASOAP SR-1025", 2.1 part of methylenebisacrylamide, 2.8 parts of styrene, 16.1 part of methyl methacrylate, 28 parts of ethyl acrylate, and 21 parts of n-butyl acrylate.

Monomer emulsion for shell formation: A monomer emulsion for shell formation was obtained by mixing and stirring 17 parts of deionized water, 1.2 parts of "ADEKA REASOAP SR-1025", 0.03 parts of ammonium persulfate, 3 parts of styrene, 5.1 part of 2-hydroxyethyl acrylate, 5.1 part of methacrylic acid, 6 parts of methyl methacrylate, 1.8 parts of ethyl acrylate, and 9 parts of n-butyl acrylate.

Production Example 2

35 parts of propylene glycol monopropyl ether was introduced into a reaction vessel equipped with a thermometer, thermostat, stirrer, reflux condenser, nitrogen introduction tube, and dropping device. The contents were heated to 85° C. Thereafter, a mixture of 30 parts of methyl methacrylate, 20 parts of 2-ethylhexyl acrylate, 29 parts of n-butyl acrylate, 15 parts of 2-hydroxyethyl acrylate, 6 parts of acrylic acid, 15 parts of propylene glycol monopropyl ether, and 2.3 parts of 2,2-azobis(2,4-dimethylvaleronitrile) was dropped thereinto over 4 hours. After completion of the dropping, the contents were aged for 1 hour. Furthermore, a mixture of 10 parts of propylene glycol monopropyl ether and 1 part of 2,2'-azobis(2,4-dimethylvaleronitrile) was dropped thereinto over 1 hour. After completion of the dropping, the contents were aged for 1 hour. 7.4 parts of diethanolamine was further added thereto. Thus, a solution (b) of a hydroxyl group-containing acrylic resin was obtained, the solution (b) having a solid content of 55%. The hydroxyl group-containing acrylic resin obtained had an acid value of 47 mg-KOH/g and a hydroxyl value of 72 mg-KOH/g.

Production Example 3

109 parts of trimethylolpropane, 141 parts of 1,6-hexanediol, 126 parts of 1,2-cyclohexanedicarboxylic anhydride, and 120 parts of adipic acid were introduced into a reaction vessel equipped with a thermometer, thermostat, stirrer, reflux condenser, and water separator. The contents were heated from 160° C. to 230° C. over 3 hours, and the heated contents were then subjected to condensation reaction at 230° C. for 4 hours. Subsequently, 38.3 parts of trimellitic anhydride was added thereto and the mixture was reacted at 170° C. for 30 minutes in order to introduce carboxyl groups into the product of the condensation reaction. The resultant mixture was diluted with 2-ethyl-1-hexanol to obtain a solution (c) of a hydroxyl group-containing polyester resin, the solution (c) having a solid content of 70%. The hydroxyl group-containing polyester resin obtained had an acid-value of 46 mg-KOH/g, a hydroxyl value of 150 mg-KOH/g, and a number-average molecular weight of 1,400.

<Production of First Colored Coating Materials Nos. 1 to 4 and Second Colored Coating Materials Nos. 1 to 6>

With respect to each of the first colored coating materials, color pigments including both glitter pigments and organic red pigments were added, in the respective amounts shown in Table 1, to a mixture of 50 parts (15 parts on solid basis) of the acrylic resin emulsion (a) obtained in Production Example 1, 45.5 parts (25 parts on solid basis) of the acrylic resin solution (b) obtained in Production Example 2, 42.8 parts (30 parts on solid basis) of the polyester resin solution (c) obtained in Production Example 3, and 37.5 parts (30 parts on solid basis) of a melamine resin (trade name "CYMEL 325", manufactured by Nihon Cytec Industries Inc.; solid content 80%). With respect to each of the second colored coating materials, color pigments including red pigments were added, in the respective amounts shown in Table 1, to the mixture. Each of the resultant mixtures was stirred and mixed, and a poly(acrylic acid)-based thickener (trade name "PRIMAL ASE-60", manufactured by Rohm and Hass Japan K.K.), 2-(climethylamino)ethanol, and deionized water were added thereto to regulate the mixture so as to have a pH of 8.0, a coating-material solid content of 25%, and a viscosity, as measured at 20° C. with Ford cup No. 4, of 40 seconds. Thus, first colored coating materials Nos. 1 to 4 and second colored coating materials Nos. 1 to 6 were obtained. The first colored coating material No. 4 and second colored coating materials Nos. 5 and 6 are for Comparative Examples.

Details of the pigments shown in Table 1 are as follows.

[Color Pigments]

Pigment Red 264: diketopyrrolopyrrole pigment; transparent type

Pigment Red 202: quinacridone pigment; transparent type

Pigment Red 101: iron oxide red pigment; hiding type

Pigment Red 179: perylene pigment; transparent type

Pigment Black 6: carbon black pigment; raven-black type

Pigment Red 101(t): iron oxide red pigment; transparent type

Pigment Blue 15-1: phthalocyanine blue pigment; transparent type

[Flaky Glitter Pigments]

Colored Aluminum Flake: colored orange metallic pigment; particle diameter, 18 μm Aluminum Flake A: silver metallic aluminum pigment; particle diameter of 17 μm Aluminum Flake B: silver metallic aluminum pigment; diameter of 16 μm (3) Production of Test Plates Examples 1 to 5 and Comparative Examples 1 to 5

Each of the first colored coating materials produced in (2) above, each of the second colored coating materials produced in (2) above, and a clear coating material were successively applied in the following manner. Thus, test plates of Examples 1 to 5 and Comparative Examples 1 to 5 were produced.

(Application of the First Colored Coating Materials)

Each of the first colored coating materials Nos. 1 to 4 produced in (2) above was applied to the object produced in (1) above, which had undergone electrodeposition coating and intermediate coating, using a miniature bell-shaped electrostatic rotary coater under the conditions of a booth temperature of 20° C. and a humidity of 75% so as to result in a thickness of about 10 μm in terms of cured-coated film thickness.

(Application of the Second Coating Materials)

After each first colored coating material had been applied, the coated object was allowed to stand at room temperature for 2 minutes. Each of the second colored coating materials Nos. 1 to 6 produced in (2) above was then applied to the uncured first colored coated film using a miniature bell-shaped electrostatic rotary coater under the conditions of a booth temperature of 20° C. and a humidity of 75% so as to result in a thickness of about 7 μm in terms of cured-coated film thickness.

(Application of Clear Coating Material)

After each second colored coating material had been applied, the coated object was allowed to stand at room temperature for 5 minutes and then preheated 80° C. for 3 minutes. Subsequently, a clear coating material (LUGABAKE CLEAR (trade name), manufactured by Kansai Paint Co., Ltd.; organic-solvent-based type including an acrylic resin and an amino resin) was applied to the uncured second colored coated film using a miniature bell-shaped electrostatic rotary coater under the conditions of a booth temperature of 20° C. and a humidity of 75% so as to result in a thickness of about 35 μm in terms of cured-coated film thickness.

The coated object was allowed to stand at room temperature for 15 minutes and then heated in a hot-air circulating drying oven at 140° C. for 30 minutes to simultaneously dry and cure the multilayer coated film composed of the first colored coated film, second colored coated film, and clear coated film. Thus, test plates were produced.

(4) Evaluation Tests

The test plates obtained in the Examples and Comparative Examples were each examined for hue angle h, chroma C*, color difference (ΔE) between the first colored coated film and the multilayer coated film, and light reflectance of the first colored coated film for each of the wavelength ranges. The test plates were further evaluated for weatherability. The test conditions used are as follows.

<Hue Angle h>

The second colored coated film obtained by applying the second colored coating material and the multilayer coated film obtained by successively applying the first colored coating material, second colored coating material, and clear coating material in the steps (1) to (3) were each examined for hue angle h according to the L*C*h color system by the method described above.

<Chroma C*>

Each multilayer coated film obtained by successively applying the first colored coating material, second colored coating material, and clear coating material in the steps (1) to (3) was examined for chroma C* according to the L*C*h color system through a color measurement with a multiangle spectrophotometer (MA-68 (trade name), manufactured by X-Rite Inc.). The light-receiving angle was set at 75°, which corresponded to shade.

<Color Difference (ΔE)>

The color difference (ΔE) according to the L*a*b* color system between the first colored coated film and the multilayer coated film obtained by successively applying the first colored coating material, second colored coating material, and clear coating material in the steps (1) to (3) was determined by the method described above.

<Light Reflectance of the First Colored Coated Film for Each Wavelength Range>

The first colored coated film having a cured-film-thickness of 10 μm was examined for light reflectance at wavelengths of 650 nm to 700 nm, light reflectance at wavelengths of 410 nm to 440 nm, and light reflectance at wavelengths of 510 nm to 590 nm by the method described above.

The hue angle h and chroma C* of the multilayer coated film, the color difference (ΔE) between the first colored coated film and the multilayer coated film, and the light reflectances of the first colored coated film for the respective wavelength ranges are shown in Table 1.

<Evaluation of Weatherability>

SUPER XENON WEATHEROMETER (trade name; manufactured by Suga Test Instruments Co., Ltd.), which is of the type as provided for in JIS B 7754, was used in an accelerated weathering test, and each test plate was repeatedly subjected to 500 cycles, each cycle taking 2 hours, i.e., being composed of irradiation with light from the xenon arc lamp conducted for 1 hour and 42 minutes and rainfall conducted for 18 minutes with irradiation with light from the lamp. After completion of the 500 cycles, the test plate was evaluated by comparing with a control coated plate which had been stored in the laboratory. The evaluation criteria are as follows. The results thereof are also shown in Table 1.

(Discoloration)

A: No discoloration was observed in the coated film

B: Discoloration was observed in the coated film (Fading)

A: No fading was observed in the coated film

B: Fading was observed in the coated film

TABLE 1

| | | Example | | | | | Comparative Example | | | | |
|---|---|---|---|---|---|---|---|---|---|---|---|
| | | 1 | 2 | 3 | 4 | 5 | 1 | 2 | 3 | 4 | 5 |
| First colored coating material No. (Pigment composition) | | 1 | 2 | 3 | 1 | 1 | 1 | 4 | 1 | 4 | 4 |
| Pigment Red 264 | (parts) | 5 | 4 | 8 | 5 | 5 | 5 | — | 5 | — | — |
| Pigment Red 202 | (parts) | 3 | 2 | 3 | 3 | 3 | 3 | — | 3 | — | — |
| Pigment Red 101 | (parts) | 1 | 1 | 1 | 1 | 1 | 1 | 1 | 1 | 1 | 1 |
| Pigment Red 179 | (parts) | — | — | — | — | — | — | 6 | — | 6 | 6 |
| Pigment Black 6 | (parts) | 0.5 | 0.5 | 0.5 | 0.5 | 0.5 | 0.5 | 0.5 | 0.5 | 0.5 | 0.5 |
| Colored Aluminum Flake | (parts) | 5 | 5 | 5 | 5 | 5 | 5 | — | 5 | — | — |
| Aluminum Flake A | (parts) | 7 | 7 | 7 | 7 | 7 | 7 | — | 7 | — | — |
| Aluminum Flake B | (parts) | — | — | — | — | — | — | 13 | — | 13 | 13 |
| Second colored coating material No.(Pigment composition) | | 1 | 1 | 1 | 2 | 3 | 4 | 1 | 5 | 5 | 6 |
| Pigment Red 179 | (parts) | 3.5 | 3.5 | 3.5 | 2.5 | 4.5 | — | 3.5 | — | — | 3.5 |
| Pigment Red 101(t) | (parts) | 0.5 | 0.5 | 0.5 | 0.5 | 0.5 | 2.5 | 0.5 | 0.5 | 0.5 | — |
| Pigment Red 202 | (parts) | — | — | — | — | — | — | — | 3.5 | 3.5 | — |
| Pigment Blue 15-1 | (parts) | — | — | — | — | — | — | — | — | — | 0.5 |
| First colored coated film: Light reflectance at 650 to 700 nm | (%) | 32 | 34 | 30 | 32 | 32 | 32 | 36 | 32 | 36 | 36 |
| First colored coated film: Light reflectance at 510 to 590 nm | (%) | 5 | 6 | 4 | 5 | 5 | 5 | 9 | 5 | 9 | 9 |
| First colored coated film: Light reflectance at 410 to 440 nm | (%) | 10 | 1 | 8 | 10 | 10 | 10 | 9 | 10 | 9 | 9 |
| Second colored coated film | (h) | 32 | 32 | 32 | 34 | 31 | 40 | 31 | 28 | 28 | 26 |
| Color difference | (ΔE) | 23 | 28 | 26 | 20 | 30 | 39 | 18 | 17 | 28 | 25 |
| Multilayer coated film, shade 75° | (h) | 32 | 33 | 36 | 35 | 31 | 38 | 40 | 24 | 26 | 41 |
| Multilayer coated film, shade 75° | (C*) | 37 | 39 | 34 | 35 | 39 | 30 | 33 | 40 | 43 | 33 |
| Weatherability (discoloration) | | A | A | A | A | A | A | B | B | B | B |
| Weatherability (fading) | | A | A | A | A | A | A | B | B | B | B |

It can be found from the results of the Examples and Comparative Examples shown in Table 1 that the multilayer coated films of Examples 1 to 5 suffered neither discoloration nor fading, showed excellent weatherability and further had a sufficient chroma C* as high as 34 or more. On the other hand, Comparative Example 1 showed satisfactory weatherability but had a poor chroma C* as low as 30. Comparative Examples 3 and 4 had a sufficient chroma but were insufficient in weatherability. Furthermore, Comparative Examples 2 and 5 were able to satisfy neither the weatherability nor the chroma. It is hence obvious that the multilayer coated films of Examples 1 to 5 are excellent in terms of both chroma and weatherability, whereas the multilayer coated films of Comparative Examples 1 to 5 are inferior in chroma and/or weatherability.

The method in an aspect of the present invention for forming a multilayer coated film is suitable for application to various industrial products, in particular, outside plates of bodies of motor vehicles.

While the invention has been described in detail and with reference to specific embodiments thereof, it will be apparent to one skilled in the art that various changes and modifications can be made therein without departing from the spirit and scope thereof.

What is claimed is:

1. A method for forming a multilayer coated film on an object to be coated, the object to be coated having undergone electrodeposition coating and intermediate coating, the method comprising the following steps (1) to (3):

step (1): applying a first water-based colored coating material to the object, thereby forming a first colored coated film, the first colored coating material containing an iron-oxide-coated aluminum pigment, a diketopyrrolopyrrole pigment, a carbon black pigment, and a quinacridone pigment, and the first colored coating material giving a cured coated film which, when having a thickness of 10 μm, has a light reflectance in a range of 30% to 35% at wavelengths of 650 nm to 700 nm and has a light reflectance in a range of 15% or less at wavelengths of 410 nm to 440 nm and at wavelengths of 510 nm to 590 nm, step (2): applying a second water-based colored coating material to the first colored coated film, thereby forming a second colored coated film, the second colored coating material containing 0.01 to 15% by mass of a perylene pigment based on the total amount of resin solid components in the second colored coating material, and the second colored coating material giving a cured coated film which, when having a thickness of 7 μm, has a hue in a range of 35°±5° in terms of hue angle h according to L*C*h color system chromaticity diagram, and step (3): applying a clear coating material to the second colored coated film, thereby forming a clear coated film, wherein a color difference ΔE between the first colored coated film and the multilayer coated film obtained by the steps (1) to (3) is in a range of 20 to 30, the first colored coated film has a thickness in a range of 5 μm to 10 μm in terms of the thickness of the cured coated film, the first colored coating material has a solid concentration of 10% to 40%, and each of the first colored coating material and the second colored coating material includes a thermosetting resin composition including: a base resin having a crosslinkable functional group, and a crosslinking agent, wherein the base resin is at least one selected from the group consisting of acrylic resins, polyester resins, alkyd resins and urethane resins, and the crosslinking agent is at least one selected from the group consisting of melamine resins, urea resins and polyisocyanate compounds.

2. The method for forming a multilayer coated film according to claim 1, wherein the second colored coated film has a thickness in a range of 4 μm to 10 μm in terms of the thickness of the cured coated film.

3. A coated article obtained by the method for forming a multilayer coated film according to claim 1.

4. The method for forming a multilayer coated film according to claim 1, wherein the second colored coating material further contains an iron oxide red pigment.

* * * * *